US009767723B2

(12) United States Patent
Kuo et al.

(10) Patent No.: US 9,767,723 B2
(45) Date of Patent: Sep. 19, 2017

(54) DEVICE AND METHOD FOR PROCESSING WAITED DISPLAY PICTURE OF OLED DISPLAY DEVICE

(71) Applicant: Shenzhen China Star Optoelectronics Technology Co., Ltd., Shenzhen, Guangdong (CN)

(72) Inventors: Ping-sheng Kuo, Guangdong (CN); Li-wei Chu, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 87 days.

(21) Appl. No.: 14/889,936

(22) PCT Filed: May 21, 2015

(86) PCT No.: PCT/CN2015/079510
§ 371 (c)(1),
(2) Date: Nov. 9, 2015

(87) PCT Pub. No.: WO2016/150004
PCT Pub. Date: Sep. 29, 2016

(65) Prior Publication Data

US 2017/0116902 A1 Apr. 27, 2017

(30) Foreign Application Priority Data

Mar. 24, 2015 (CN) ..... 2015 1 0131605

(51) Int. Cl.
*G09G 3/20* (2006.01)
*G09G 3/3208* (2016.01)

(52) U.S. Cl.
CPC ..... *G09G 3/2007* (2013.01); *G09G 3/2003* (2013.01); *G09G 3/3208* (2013.01);
(Continued)

(58) Field of Classification Search
CPC ... G09G 3/3208; G09G 3/2003; G09G 3/2007
(Continued)

(56) References Cited

U.S. PATENT DOCUMENTS

2011/0043552 A1* 2/2011 Brown Elliott ..... G09G 3/3406 345/694
2013/0169663 A1* 7/2013 Seong ..... G09G 5/00 345/589

(Continued)

*Primary Examiner* — Kimberly A Williams
(74) *Attorney, Agent, or Firm* — Andrew C. Cheng

(57) ABSTRACT

A device and a method for processing a waited display picture of an OLED display device are provided. The device includes a block dividing unit for dividing a waited display picture into multiple blocks; an average grayscale determining unit for determining an average grayscale value of each block; a high grayscale determining unit for determining a block having an average grayscale value greater than a preset threshold value as a high grayscale block; an adjacent grayscale determining unit for determining an adjacent grayscale value of each high grayscale block; and a regulation unit for adjusting grayscale values of pixels of each high grayscale block. The present invention adjusts grayscale values using a block as a unit. Besides, the difference of luminous efficiency or light transmittance of different color components is also considered so as to effectively improve the life of the OLED display device.

8 Claims, 2 Drawing Sheets

(52) U.S. Cl.
CPC ..... *G09G 2320/0233* (2013.01); *G09G 2320/043* (2013.01); *G09G 2320/0626* (2013.01); *G09G 2320/0666* (2013.01)

(58) Field of Classification Search
USPC ..... 345/589
See application file for complete search history.

(56) References Cited

U.S. PATENT DOCUMENTS

2014/0152721 A1* 6/2014 Byun ..... G09G 3/3208 345/691
2015/0103108 A1* 4/2015 Seong ..... G09G 3/22 345/694

* cited by examiner

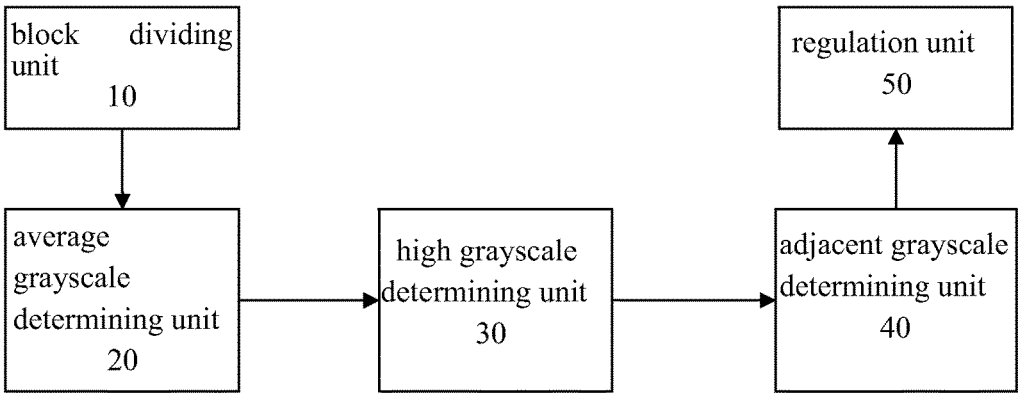
FIG. 1
| | | |
|---|---|---|
| +1 | +2 | +1 |
| +2 | (i, j) | +2 |
| +1 | +2 | +1 |
FIG. 2
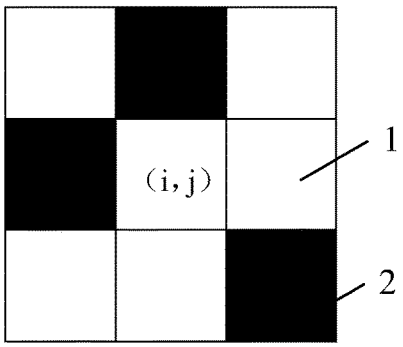
FIG. 3

DEVICE AND METHOD FOR PROCESSING WAITED DISPLAY PICTURE OF OLED DISPLAY DEVICE

BACKGROUND OF THE INVENTION

1. Field of the Invention

The present invention relates to an image processing, and more particular to a device and a method for processing a waited display picture of an OLED display device.

2. Description of Related Art

An OLED (Organic Light-Emitting Diode) display technology has a self-emitting feature, which utilizes a very thin organic layer and a glass substrate. When a current flows through, the organic coating layer can emit light. Because the OLED display device can emit light without a backlight source, and has features of high contrast ratio, thin thickness, wide viewing angle, quick response speed, flexible panel, wide temperature range and simple in structure and manufacturing process, the OLED display device has a very good application future. Currently, the OLED display device has problems of short life, high cost, insufficient color purity, and so on such that the OLED display device has not been widely recognized by the market. In the conventional art, because the high temperature, the life of the OLED display device is decreased. A method for increasing the life of the OLED display device through regulating the display brightness of the OLED display is provided. However, the method will decrease the display quality of the display picture.

Therefore, a method for improving the life of an OLED display device is required.

SUMMARY OF THE INVENTION

In order to overcome drawbacks of the conventional art, an objective of the present invention is to provide a device and a method for processing a waited display picture of an OLED display device.

In one embodiment of the present invention, the present invention provides a device for processing a waited display picture of an organic light-emitting diode (OLED) display device, comprising: a block dividing unit for dividing a waited display picture into multiple blocks; an average grayscale determining unit for determining an average grayscale value of each block; a high grayscale determining unit for determining a block having an average grayscale value greater than a preset threshold value as a high grayscale block; an adjacent grayscale determining unit for determining an adjacent grayscale value of each high grayscale block, wherein, the adjacent grayscale value of one high grayscale block is a weighting sum of average grayscale values of adjacent high grayscale blocks, and the adjacent high grayscale blocks are some high grayscale blocks that are adjacent to the one high grayscale block; and a regulation unit for adjusting grayscale values of pixels of each high grayscale block according to the adjacent grayscale value of each high grayscale block.

Wherein, the average grayscale determining unit determines an average grayscale value of each block through a following formula:

$$\text{AVE_BLK} = \frac{1}{N}\sum_{k=1}^{N}(\alpha R_k + \beta G_k + \gamma B_k)$$

wherein, AVE_BLK represents an average grayscale value of one block, N represents the number of the pixels in one block, $R_k$ represents a grayscale value of red color component of a k-th pixel in N pixels, $G_k$ represents a grayscale value of green color component of a k-th pixel in N pixels, $B_k$ represents a grayscale value of blue color component of a k-th pixel in N pixels; α, β, and γ respectively represent weight values of $R_k$, $G_k$, and $B_k$; (impossible) Wherein, $\beta<\alpha<\gamma$.

Wherein, when calculating the weighting sum, an adjacent grayscale block which has a longer boundary with the one high grayscale block has a greater weight.

Wherein, the regulation unit utilizes an adjustment coefficient corresponding to the adjacent grayscale value of each high grayscale block to adjust a grayscale value of each color component of pixels in each high grayscale block, wherein, when the adjacent grayscale value is larger, the adjustment coefficient corresponding to the adjacent grayscale value is smaller.

In one embodiment of the present invention, the present invention provides a method for processing a waited display picture of an organic light-emitting diode (OLED) display device, comprising steps of: (a) dividing a waited display picture into multiple blocks; (b) determining an average grayscale value of each block; (c) determining a block having an average grayscale value greater than a preset threshold value as a high grayscale block; (d) determining an adjacent grayscale value of each high grayscale block, wherein, the adjacent grayscale value of one high grayscale block is a weighting sum of average grayscale values of adjacent high grayscale blocks, and the adjacent high grayscale blocks are some high grayscale blocks that are adjacent to the one high grayscale block; and (e) adjusting grayscale values of pixels of each high grayscale block according to the adjacent grayscale value of each high grayscale block.

Wherein, in step (b), through a following formula to determine an average grayscale value of one block:

$$\text{AVE_BLK} = \frac{1}{N}\sum_{k=1}^{N}(\alpha R_k + \beta G_k + \gamma B_k)$$

wherein, AVE_BLK represents an average grayscale value of one block, N represents the number of the pixels in one block, $R_k$ represents a grayscale value of red color component of a k-th pixel in N pixels, $G_k$ represents a grayscale value of green color component of a k-th pixel in N pixels, $B_k$ represents a grayscale value of blue color component of a k-th pixel in N pixels; α, β, and γ respectively represent weight values of $R_k$, $G_k$, and $B_k$; Wherein, $\beta<\alpha<\gamma$.

Wherein, in step (d), when calculating the weighting sum, an adjacent grayscale block which has a longer boundary with the one high grayscale block has a greater weight.

Wherein, step (e) includes: utilizing an adjustment coefficient corresponding to the adjacent grayscale value of each high grayscale block to adjust a grayscale value of each color component of pixels in each high grayscale block, wherein, when the adjacent grayscale value is larger, the adjustment coefficient corresponding to the adjacent grayscale value is smaller.

In a device and a method for processing a waited display picture of an OLED display device according to an embodiment of the present invention, the present invention adjusts grayscale values using one block as one unit. Comparing to the conventional art which use an entire display picture as one unit to adjust grayscale values, the present invention can precisely adjust the brightness and the temperature when the OLED display device is displaying a display picture in order to effectively improve the life of the OLED display device. Besides, in the process of adjusting the grayscale values of the blocks, the grayscale values of adjacent blocks are also considered in order to more precisely adjust the brightness and the temperature of the OLED display device.

Besides, in the process of adjusting the grayscale values of the blocks, the difference of luminous efficiency or light transmittance of different color components are also considered in order to more precisely adjust the brightness and the temperature of the OLED display device so as to improve the life of the OLED.

BRIEF DESCRIPTION OF THE DRAWINGS

FIG. 1 is schematic block diagram of a device for processing a waited display picture of an OLED display device according to an embodiment of the present invention;

FIG. 2 is a schematic diagram of calculating a weight of adjacent grayscale value according to an embodiment of the present invention;

FIG. 3 is a schematic diagram of adjacent grayscale blocks according to an embodiment of the present invention.

DETAILED DESCRIPTION OF THE PREFERRED EMBODIMENT

Figure 4:
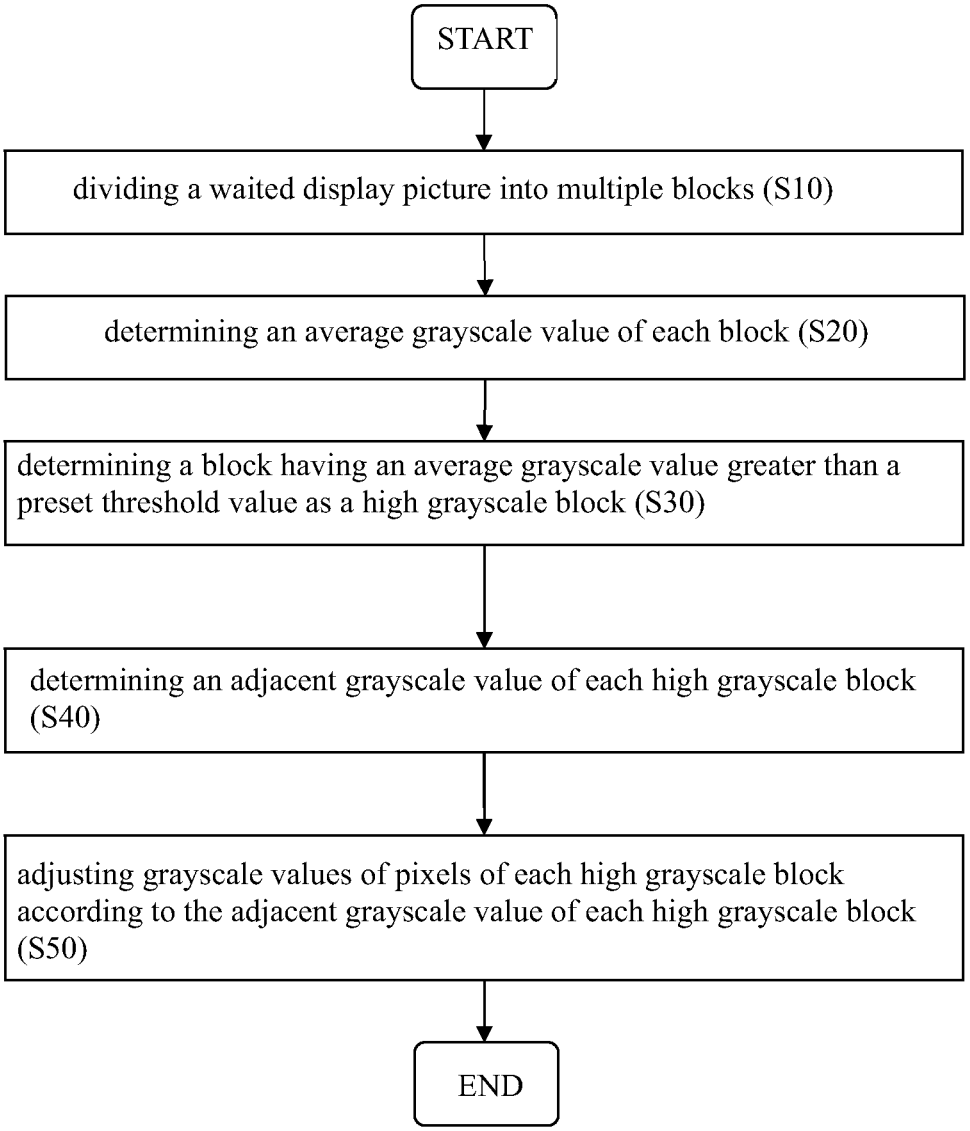
FIG. 4 is a flowchart of a method for processing a waited display picture of an OLED display device according to an embodiment of the present invention.

The following content combines figures and embodiments for detail description of the present invention.

FIG. 1 is schematic block diagram of a device for processing a waited display picture of an OLED display according to an embodiment of the present invention. Before the OLED display device shows a waited display picture, through processing the display picture, the OLED display device will show a display picture after processed.

The device for processing a waited display picture of the OLED display device includes: a block dividing unit 10, an average grayscale determining unit 20, a high grayscale determining unit 30, an adjacent grayscale determining unit 40, and a regulation unit 50. The above units can be realized by a general hardware processor such as a digital signal processor, or a field programmable gate array (FPGA) and so on. The above units can also be realized by an application-specific hardware processor. The above units can also be realized by a computer program through software such as image processing software.

With reference to FIG. 1, the block dividing unit 10 divides a waited display picture into multiple blocks. The multiple blocks are arbitrary-shaped blocks. For example, each of the multiple blocks is a rectangle or a square. For calculating conveniently, preferably, each of the multiple blocks is a square.

The average grayscale determining unit 20 determines an average grayscale value of each block. The average grayscale value of each block indicates an average of grayscale values of all pixels in one block. Preferably, considering the display difference of different color components (red color, blue color, and green color) on the OLED display device, the average grayscale value of each block indicates a weighting average value of grayscale values of all pixels in one block. Correspondingly, for example, the average grayscale determining unit 20 can determine the average grayscale value of each block through a following formula (1)

$$\text{AVE_BLK} = \frac{1}{N}\sum_{k=1}^{N}(\alpha R_k + \beta G_k + \gamma B_k) \tag{1}$$

Wherein, AVE_BLK represents an average grayscale value of one block, N represents the number of the pixels in one block, $R_k$ represents a grayscale value of red color component of a k-th pixel in N pixels, $G_k$ represents a grayscale value of green color component of a k-th pixel in N pixels, $B_k$ represents a grayscale value of blue color component of a k-th pixel in N pixels; α, β and γ respectively represent weight values of $R_k$, $G_k$, and $B_k$; which can set the values of α, β and γ according to the display difference of different color components (red color, blue color and green color) on the OLED display device.

In a preferably embodiment, setting the values of α, β and γ according to the difference of luminous efficiency and light transmittance of different color components (red color, blue color and green color) on the OLED display device. Specifically, when considering luminous efficiency and light transmittance of different color components, an order is: green color component is greater than red color component; red color component is greater than blue color component. Accordingly, in the present invention, a relationship among α, β and γ is that $\beta<\alpha<\gamma$.

The high grayscale determining unit 30 determines a block having an average grayscale value greater than a preset threshold value as a high grayscale block. Here, the preset threshold value can be set and changed. For example, the high grayscale determining unit 30 can mark a block which is determined as a high grayscale block in order to facilitate a following process.

The adjacent grayscale determining unit 40 determines an adjacent grayscale value of each high grayscale block. Here, the adjacent grayscale value of one high grayscale block is a weighting sum of average grayscale values of all pixels in adjacent high grayscale blocks. The adjacent high grayscale blocks are some high grayscale blocks that are adjacent to the one high grayscale block. Here, the adjacent high grayscale blocks include some high grayscale blocks which have a common edge or a common point with one high grayscale block. Preferably, when calculating the weighting sum, an adjacent grayscale block which has a longer boundary with the one high grayscale block has a greater weight. Preferably, the adjacent grayscale determining unit 40 can determine an adjacent grayscale value of each high grayscale block through presetting a weight of each adjacent high grayscale block.

FIG. 2 is a schematic diagram of calculating a weight of an adjacent grayscale value according to an embodiment of the present invention. FIG. 3 is a schematic diagram of adjacent grayscale blocks according to an embodiment of the present invention. In FIG. 2, weights of adjacent high grayscale blocks are arranged as the same arrangement way as corresponded adjacent grayscale blocks shown in FIG. 3. For example, a weight (+1) of an adjacent grayscale block (block(i−1,j−1)) is located at an upper left corner in FIG. 2. When multiple blocks of a waited display picture divided by the block dividing unit 10 is a square or a rectangle, weights of adjacent grayscale blocks can be exemplarily arranged as shown in FIG. 2. FIG. 3 shows a high grayscale block (block (i,j)) of i-th column and j-th row and blocks adjacent to the high grayscale block (block (i,j)). Wherein, a white square 1 represents a high grayscale block, and a black square 2 represents a non-high grayscale block. The adjacent high grayscale blocks include block(i−1,j−1), block(i+1,j−1), block(i+1,j), block(i−1,j+1), and block(i,j+1). An adjacent grayscale value of the high grayscale block (block(i,j)) can be determined through a following formula (2).

$$\text{Weigh_sum}(i,j)=\text{AVE_BLK}(i-1,j-1)\times 1+\text{AVE_BLK}(i+1,j-1)\times 1+\text{AVE_BLK}(i+1,j)\times 2+\text{AVE_BLK}(i-1,j+1)\times 1+\text{AVE_BLK}(i,j+1)\times 2 \quad (2)$$

Wherein, Weigh_sum(i,j) represents the adjacent grayscale value of the high grayscale block (block(i,j)); AVE_BLK (i−1,j−1), AVE_BLK (i+1,j−1), AVE_BLK (i+1,j), AVE_BLK (i−1,j+1) and AVE_BLK (i,j+1) respectively indicate average grayscale values of block(i−1,j−1), block (i+1,j−1), block(i+1,j), block(i−1,j+1) and block(i,j+1).

The regulation unit 50 adjusts grayscale values of pixels of each high grayscale block according to the adjacent grayscale value of each high grayscale block. Specifically, the regulation unit 50 adjusts grayscale values of each color component of pixels in each high grayscale block, which includes a grayscale value of a red color component, a grayscale value of a blue color component and a grayscale value of a green color component. For example, the regulation unit 50 utilizes an adjustment coefficient corresponding to the adjacent grayscale value of each high grayscale block to adjust the grayscale value of each color component of pixels in each high grayscale block. Wherein, when the adjacent grayscale value is larger, the adjustment coefficient corresponding to the adjacent grayscale value is smaller. That is, when an adjacent grayscale value of a high grayscale block is larger, a reduced proportion of a grayscale value after adjusted by the regulation unit is larger.

FIG. 4 is a flowchart of a method for processing a waited display picture of an OLED display device according to an embodiment of the present invention. Before the OLED display device shows a waited display picture, the present invention processes the waited display picture through the method described above. After the waited display picture has been processed, the OLED display device shows a waited display picture after being processed.

With reference to FIG. 4, in a step S10, dividing a waited display picture into multiple blocks. The multiple blocks are arbitrary-shaped blocks. For example, each of the multiple blocks is a rectangle or a square. For calculating conveniently, preferably, each of the multiple blocks is a square.

In a step S20, determining an average grayscale value of each block. The average grayscale value of each block indicates an average of grayscale values of all pixels in one block. Preferably, considering the display difference of different color components (red color, blue color, and green color) on the OLED display device, the average grayscale value of each block indicates a weighting average value of grayscale values of all pixels in one block. Correspondingly, for example, in the step S20, the average grayscale value of each block can be determined through the above formula (1).

Here, the present invention can set the values of α, β and γ according to the display difference of different color components (red color, blue color and green color) on the OLED display device.

In a prefer embodiment, setting the values of α, β and γ according to the difference of luminous efficiency and light transmittance of different color components (red color, blue color and green color) on the OLED display device. Specifically, for a RGB (respectively a red color, a green color, and a blue color) OLED display device formed by an evaporation process, the luminous efficiency is G>R>B. For a OLED display device formed by a WOLED (White Organic Light-Emitting Diode) and a color filter, the luminous efficiency is also G>R>B. Accordingly, in the present invention, a relationship among α, β and γ is arranged as $\beta<\alpha<\gamma$.

In step S30, determining a block having an average grayscale value greater than a preset threshold value as a high grayscale block. Here, the preset threshold value can be set and changed. For example, in the step S30, the present embodiment can mark a block which is determined as a high grayscale block in order to facilitate a following process.

In step S40, determining an adjacent grayscale value of each high grayscale block. Here, the adjacent grayscale value of one high grayscale block is a weighting sum of average grayscale values of all pixels in adjacent high grayscale blocks. The adjacent high grayscale blocks are some high grayscale blocks that are adjacent to the one high grayscale block. Here, the adjacent high grayscale blocks include some high grayscale blocks which have a common edge or a common point with one high grayscale block. Preferably, when calculating the weighting sum, an adjacent grayscale block which has a longer boundary with the one high grayscale block has a greater weight. Preferably, in step S40, the adjacent grayscale value of each high grayscale block can be determined through presetting a weight of each adjacent high grayscale block.

FIG. 2 is a schematic diagram of calculating a weight of an adjacent grayscale value according to an embodiment of the present invention. FIG. 3 is a schematic diagram of adjacent grayscale blocks according to an embodiment of the present invention. In FIG. 2, weights of adjacent high grayscale blocks are arranged as the same arrangement way as corresponded adjacent grayscale blocks shown in FIG. 3. For example, a weight (+1) of an adjacent grayscale block (block(i−1,j−1)) is located at an upper left corner in FIG. 2. When multiple blocks of a waited display picture divided by the block dividing unit 10 is a square or a rectangle, weights of adjacent grayscale blocks can be exemplarily arranged as shown in FIG. 2. FIG. 3 shows a high grayscale block (block (i,j)) of i-th column and j-th row and blocks adjacent to the high grayscale block (block (i,j)). Wherein, a white square 1 represents a high grayscale block, and a black square 2 represents a non-high grayscale block. The adjacent high grayscale blocks include block(i−1,j−1), block(i+1,j−1), block(i+1,j), block(i−1,j+1), and block(i,j+1). An adjacent grayscale value of the high grayscale block (block(i,j)) can be determined through the above formula (2).

In step S50, adjusting grayscale values of pixels of each high grayscale block according to the adjacent grayscale value of each high grayscale block. Specifically, in step S50, the present invention adjusts grayscale values of each color component of pixels in each high grayscale block, which includes a grayscale value of a red color component, a grayscale value of a blue color component and a grayscale value of a green color component. For example, the step S50 utilizes an adjustment coefficient corresponding to the adjacent grayscale value of each high grayscale block to adjust the grayscale value of each color component of pixels in each high grayscale block. Wherein, when the adjacent grayscale value is larger, the adjustment coefficient corresponding to the adjacent grayscale value is smaller. That is, when an adjacent grayscale value of a high grayscale block is larger, a reduced proportion of a grayscale value after adjusted by the regulation unit is larger. The method for processing a waited display picture of the OLED display can be realized by above units, or be realized by readable codes of a computer on a computer readable record media. The computer readable record media can be any data storage device which can be read out by a computer system. For example, the computer readable record media can be a ROM (Read-Only Memory), a RAM (Random Access Memory), a CD-ROM, a magnetic tape, a floppy disk, an optical data storage devices, or a carrier wave (such as data transmission via a wired or wireless transmission path through the internet). The computer readable record media can be a computer system distributed in a connected network so that the computer readable codes can be stored and executed discretely. Besides, function processes, codes, code segments for finishing the present invention can be explained easily by an ordinary programmer in a related filed of the present invention in the claims of the present invention.

In a device and a method for processing a waited display picture of an OLED display device according to an embodiment of the present invention, the present invention adjusts grayscale values using one block as one unit. Comparing to the conventional art which use an entire display picture as one unit to adjust grayscale values, the present invention can precisely adjust the brightness and the temperature when the OLED display device is displaying a display picture in order to effectively improve the life of the OLED display device. Besides, in the process of adjusting the grayscale values of the blocks, the grayscale values of adjacent blocks are also considered in order to more precisely adjust the brightness and the temperature of the OLED display device.

Besides, in the process of adjusting the grayscale values of the blocks, the difference of luminous efficiency or light transmittance of different color components are also considered in order to more precisely adjust the brightness and the temperature of the OLED display device so as to improve the life of the OLED.

The above embodiments of the present invention are not used to limit the claims of this invention. Any use of the content in the specification or in the drawings of the present invention which produces equivalent structures or equivalent processes, or directly or indirectly used in other related technical fields is still covered by the claims in the present invention.

What is claimed is:

1. A device for processing a display picture of an organic light-emitting diode (OLED) display device, comprising:

a block dividing unit for dividing a display picture of an organic light-emitting diode (OLED) display device into multiple blocks;

an average grayscale determining unit for determining an average grayscale value of all pixels of each block;

a high grayscale determining unit for determining a block having an average grayscale value greater than a preset threshold value as a high grayscale block;

an adjacent grayscale determining unit for determining an adjacent grayscale value of each high grayscale block, wherein, the adjacent grayscale value of one high grayscale block is a weighting sum of average grayscale values of adjacent high grayscale blocks, and the adjacent high grayscale blocks are some high grayscale blocks that are adjacent to the one high grayscale block; and a regulation unit for adjusting grayscale values of pixels of each high grayscale block according to the adjacent grayscale value of each high grayscale block;

wherein, the average grayscale determining unit determines an average grayscale value of each block through a following formula:

$$\mathrm{AVE_BLK} = \frac{1}{N}\sum_{k=1}^{N}(\alpha R_k + \beta G_k + \gamma B_k)$$

wherein, AVE_BLK represents an average grayscale value of one block, N represents the number of the pixels in one block, $R_k$ represents a grayscale value of red color component of a k-th pixel in N pixels, $G_k$ represents a grayscale value of green color component of a k-th pixel in N pixels, $B_k$ represents a grayscale value of blue color component of a k-th pixel in N pixels; α, β, and γ respectively represent weight values of $R_k$, $G_k$, and $B_k$; and wherein, α, β, and γ are determined according to the difference of luminous efficiency and light transmittance of the red color, the green color and the blue color components on the OLED display device.

2. The device according to claim 1, wherein, $\beta<\alpha<\gamma$.

3. The device according to claim 1, wherein, when calculating the weighting sum, an adjacent grayscale block which has a longer boundary with the one high grayscale block has a greater weight.

4. The device according to claim 1, wherein, the regulation unit utilizes an adjustment coefficient corresponding to the adjacent grayscale value of each high grayscale block to adjust a grayscale value of each color component of pixels in each high grayscale block, wherein, when the adjacent grayscale value is larger, the adjustment coefficient corresponding to the adjacent grayscale value is smaller.

5. A method for processing a display picture of an organic light-emitting diode (OLED) display device, comprising steps of:

(a) dividing a display picture of an organic light-emitting diode (OLED) display device into multiple blocks;

(b) determining an average grayscale value of all pixels of each block;

(c) determining a block having an average grayscale value greater than a preset threshold value as a high grayscale block;

(d) determining an adjacent grayscale value of each high grayscale block, wherein, the adjacent grayscale value of one high grayscale block is a weighting sum of average grayscale values of adjacent high grayscale blocks, and the adjacent high grayscale blocks are some high grayscale blocks that are adjacent to the one high grayscale block; and (e) adjusting grayscale values of pixels of each high grayscale block according to the adjacent grayscale value of each high grayscale block;

wherein, in step (b), through a following formula to determine an average grayscale value of one block:

$$\mathrm{AVE_BLK} = \frac{1}{N}\sum_{k=1}^{N}(\alpha R_k + \beta G_k + \gamma B_k)$$

wherein, AVE_BLK represents an average grayscale value of one block, N represents the number of the pixels in one block, $R_k$ represents a grayscale value of red color component of a k-th pixel in N pixels, $G_k$ represents a grayscale value of green color component of a k-th pixel in N pixels, $B_k$ represents a grayscale value of blue color component of a k-th pixel in N pixels; α, β, and γ respectively represent weight values of $R_k$, $G_k$, and $B_k$; and wherein, $\alpha$, $\beta$, and $\gamma$ are determined according to the difference of luminous efficiency and light transmittance of the red color, the green color and the blue color components on the OLED display device.

6. The method according to claim 5, wherein, $\beta<\alpha<\gamma$.

7. The method according to claim 5, wherein, in step (d), when calculating the weighting sum, an adjacent grayscale block which has a longer boundary with the one high grayscale block has a greater weight.

8. The method according to claim 5, wherein, step (e) includes: utilizing an adjustment coefficient corresponding to the adjacent grayscale value of each high grayscale block to adjust a grayscale value of each color component of pixels in each high grayscale block, wherein, when the adjacent grayscale value is larger, the adjustment coefficient corresponding to the adjacent grayscale value is smaller.

* * * * *